US012042898B2

(12) United States Patent
Gruber

(10) Patent No.: US 12,042,898 B2
(45) Date of Patent: Jul. 23, 2024

(54) SLIDE-GRINDING BODY

(71) Applicant: Rösler Holding GmbH, Bad Staffelstein (DE)

(72) Inventor: Franz Gruber, Neustadt an der Waldnaab (DE)

(73) Assignee: Rösler Holding GmbH, Bad Staffelstein (DE)

( * ) Notice: Subject to any disclaimer, the term of this patent is extended or adjusted under 35 U.S.C. 154(b) by 674 days.

(21) Appl. No.: 17/274,210

(22) PCT Filed: Sep. 11, 2019

(86) PCT No.: PCT/EP2019/000264
§ 371 (c)(1),
(2) Date: Mar. 8, 2021

(87) PCT Pub. No.: WO2020/052797
PCT Pub. Date: Mar. 19, 2020

(65) Prior Publication Data

US 2021/0268623 A1 Sep. 2, 2021

(30) Foreign Application Priority Data

Sep. 11, 2018 (DE) ..... 102018007188.0

(51) Int. Cl.
*B24B 31/14* (2006.01)

(52) U.S. Cl.
CPC ..... *B24B 31/14* (2013.01)

(58) Field of Classification Search
CPC ..... B24B 31/14; B24B 31/16; B24C 11/00; B24C 11/065; C09K 3/1409; B24D 3/04; B24D 3/08; B24D 3/14; B24D 3/16; B02C 17/20
USPC ..... 451/30; 241/184
See application file for complete search history.

(56) References Cited

U.S. PATENT DOCUMENTS

| | | | |
|---|---|---|---|
| 1,218,158 A | 3/1917 | Andrews | |
| 2,947,124 A | 8/1960 | Madigan et al. | |
| 8,746,602 B2 * | 6/2014 | Bodurov | B02C 17/20 241/184 |

(Continued)

FOREIGN PATENT DOCUMENTS

| | | |
|---|---|---|
| DE | 2538053 A1 | 3/1976 |
| DE | 2735399 A1 | 2/1979 |

(Continued)

OTHER PUBLICATIONS

International Search Report and Written Opinion, with English translation, mailed Jan. 27, 2020 for PCT Application No. PCT/EP2019/000264, filed Sep. 11, 2019, 14 pages.

(Continued)

*Primary Examiner* — Eric J Rosen
*Assistant Examiner* — Robert C Moore
(74) *Attorney, Agent, or Firm* — Dickinson Wright PLLC

(57) ABSTRACT

The invention related to a slide-grinding body having two sections that come to a point and emanate from a base cross-section, wherein the geometry of the base cross-section (4) has curved flanks, the base cross-section is the largest at the centre and the cross-section becomes linearly or exponentially smaller towards the points of the sections (2).

15 Claims, 1 Drawing Sheet

(56) References Cited

U.S. PATENT DOCUMENTS

Figure 1:
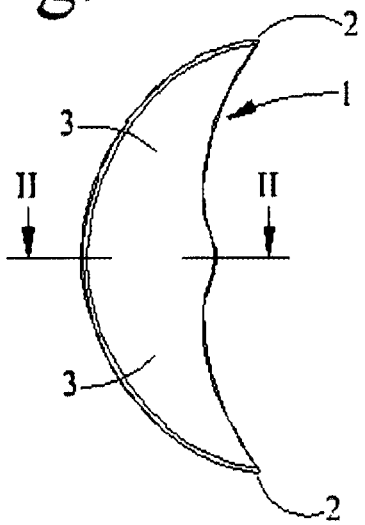

| | | | | |
|---|---|---|---|---|
| 2015/0210910 | A1* | 7/2015 | Hejtmann | B28B 1/004 51/307 |
| 2015/0291866 | A1 | 10/2015 | Arcona et al. | |
| 2019/0284460 | A1* | 9/2019 | Fuss-Dezelic | B24C 11/00 |

FOREIGN PATENT DOCUMENTS

| | | | |
|---|---|---|---|
| DE | 3812491 | A1 | 10/1989 |
| DE | 3932797 | A1 | 4/1990 |
| DE | 102006047442 | B3 | 4/2008 |
| EP | 0523624 | A2 | 1/1993 |
| GB | 1232904 | A | 5/1971 |

OTHER PUBLICATIONS

First German Office Action mailed Apr. 10, 2019 for German Application No. 102018007188.0, 4 pages.
Second German Office Action mailed May 16, 2019 for German Application No. 102018007188.0, 4 pages.

* cited by examiner

SLIDE-GRINDING BODY

CROSS-REFERENCE TO RELATED APPLICATIONS

This application is a 371 National Phase Application of Patent Application PCT/EP2019/000264, filed on Sep. 11, 2019, which claims the priority of German Patent Application 102018007188.0, filed on Sep. 11, 2018, each of which is incorporated herein by reference, in their entirety.

The invention relates to a slide grinding body comprising a number of tapering sections, in particular comprising two tapering sections, that originate from a base cross-section. This base section preferably comprises a kind of unequal triangle. However, it can also be round, elliptical or square or have another geometry.

Slide grinding bodies are known from DE 10 2006 047 442 B3 and DE 25 380 53 A1. These documents describe conical and pyramidal grinding bodies that each have a tip section that has a base surface disposed opposite it. The base surface forms the diameter with the largest area in each case. Frustoconical grinding bodies are disclosed by DE 27 35 399. EP 05 23 624 A2 describes the composition of a slide grinding body on the basis of a substantially frustoconical slide grinding body. The base cross-section of a slide grinding body described there has a cylindrical shape. U.S. Pat. No. 2,947,124 describes slide grinding bodies of different designs, among other things, also grinding bodies with a prismatic shape.

For the slide grinding of complex and precise workpieces having deep pockets or blind holes, slide grinding bodies are required that are small or that are designed such that they uniformly reach the workpiece surface to be processed without jamming. Furthermore, the grinding bodies should be shaped such that a screen separation is possible.

It is the underlying object of the invention to improve the smoothing-forming grinding bodies from an application aspect. The clamping tendency should in particular be significantly reduced and a very uniform processing over complex workpiece surfaces should to be ensured.

The object is satisfied by a slide grinding body having the features of claim 1. Advantageous embodiments of the invention are set forth in the dependent claims.

A basic idea of the invention comprises providing a grinding body that has a completely irregular shape.

In accordance with a preferred embodiment of the invention with two sections, it is initially and essentially provided that these two tapered sections originate from a larger middle cross-section in a straight or curved manner. A preferably symmetrically sickle-shaped grinding body thereby results. The middle base cross-section is the largest and is preferably formed by a kind of triangle. In this respect, the two shorter legs are curved outwardly and the long leg is curved inwardly. Any desired other geometries can also be used for the base cross-section such as a circle, an ellipse, a rectangle, a square, a polygon with straight or curved flanks with or without a rounding, a star, an angle or the like.

It has proven to be particularly advantageous for the suitability of the grinding body if the cross-section decreases linearly or exponentially toward the tips. Each tapered section can additionally be superposed by a respective helix that originates from the base cross-section. In particular in the embodiment with two sections, the transition of the two helices in the base cross-section can be rounded with a radius.

The material of the slide grinding body can be more or less abrasive depending on the application. It can be a compound material. The material can be a ceramic material. However, it is also possible that hard material particles are embedded in a synthetic resin compound, for example in a polyester compound or in an epoxy resin compound or the like. For certain applications, a design of metal, e.g. steel or stainless steel, is also conceivable. Designs in different plastics and organic materials are also possible.

The size of the slide grinding body can be adapted in accordance with the application. The size and shape of the base cross-section, the length and rounding of the tapered sections, and the pitch and diameter of the helix can likewise be adapted to the applications. Depending on the embodiment, this geometric shape can be used for different surface treatment processes.

Figure 2:
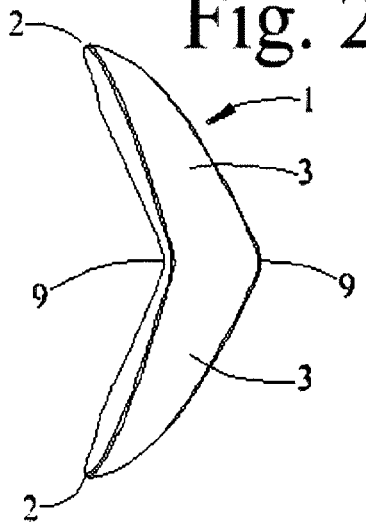
Figure 3:
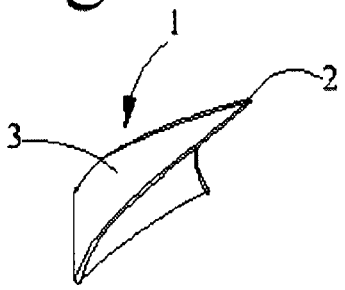

An embodiment of the invention will be explained in the following with reference to the enclosed drawings. There are shown FIG. 1 the front view of a slide grinding body;

FIG. 2 the side view of a slide grinding body;

FIG. 3 the plan view of a slide grinding body; and

Figure 4:
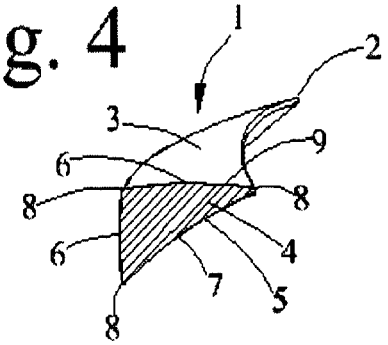

FIG. 4 a section in accordance with the line II-II in FIG. 1.

All of the Figures do not show the invention to scale, but merely schematically in this respect and only with its essential components. The same reference numerals in this respect correspond to elements having the same or a comparable function.

The slide grinding body 1 of the embodiment has exactly two tapered sections 2 that originate from a larger middle cross-section 4 in a helical manner. In other words, the two sections 2 are superposed by two helical curvatures and originate from a base cross-section 4 connecting them. A symmetrically sickle-shaped grinding body 1 thereby results. The middle base cross-section 4 is the largest and is formed by a kind of triangle 5, wherein the two shorter legs 6 curve outwardly and the long leg 7 curves inwardly. The cross-section decreases exponentially toward the tips 2. Each tapered section 2 is additionally superposed by a respective helix 3 that originates from the base cross-section 4. The transition of the two helices 3 in the base cross-section 4 is rounded with a radius 9. From the cross-section, the two tapered sections 2 each screw away from the concave side 7 in a helical manner.

The grinding body 1 is composed of a ceramic material, for example. However, it can also have hard material particles, in particular abrasive ceramic particles, that are bonded in a plastic matrix.

The size of the slide grinding body 1 approximately corresponds to that of the already known grinding body geometries, but can be selected approximately 50% larger in accordance with the application. The size and shape of the base cross-section, the length and rounding of the tapered sections, and the pitch and diameter of the helix can likewise be adapted to the applications.

The invention inter alia relates to a slide grinding body 1 comprising a number of tapering sections 2 that are preferably rounded, that are superposed by helical curvatures 3, and that originate from a base cross-section 4 connecting the sections. This base cross-section 4 preferably comprises a kind of unequal triangle 5. The base cross-section 4 preferably has arched legs 6, 7 and rounded edges 8, but it can also be round, elliptical, square or have another geometry. If exactly two sections are provided, the transition between the two tapering sections 2 in the region of the base cross-section 4 is preferably rounded with a transition radius 9.

The invention thus inter alia relates to a slide grinding body 1 comprising one or more tapering sections 2; and a base cross-section 4 that is connected thereto and that has curvatures 3. Said base cross-section 4 preferably comprises a kind of unequal triangle 5, but it can also be round, elliptical, square or have another geometry.

In accordance with a preferred embodiment of the invention, the slide grinding body in accordance with the invention is characterized in that the tapered sections 2 decrease exponentially.

In accordance with a preferred embodiment of the invention, the slide grinding body in accordance with the invention is characterized in that the curved tapered sections 2 extend helically.

In accordance with a preferred embodiment of the invention, the slide grinding body in accordance with the invention is characterized in that the helical curvatures 3 project symmetrically from the base cross-section 4.

In accordance with a preferred embodiment of the invention, the slide grinding body in accordance with the invention is characterized in that the helical curvatures 3 in the region of the base cross-section 4 are rounded with a radius.

In accordance with a preferred embodiment of the invention, the slide grinding body in accordance with the invention is characterized in that the base cross-section comprises a kind of triangle (5) whose legs 6, 7 are curved.

In accordance with a preferred embodiment of the invention, the slide grinding body in accordance with the invention is characterized in that the base cross-section 4 is rounded at the corners 8.

In accordance with a preferred embodiment of the invention, the slide grinding body in accordance with the invention is characterized in that the tip section 2 is rounded.

In accordance with a preferred embodiment of the invention, the slide grinding body in accordance with the invention is characterized in that it is adapted to other known applications, for instance as a blasting grain or grinding grain or as a polishing aid, a drying aid, and a cleaning aid.

Furthermore, the invention inter alia relates to a slide grinding body 1 comprising two tapering sections 2 that originate from a base section 4 in a curved manner or in a curved and helical manner, wherein the base cross-section 4 forms a triangle in which the two shorter legs are curved outwardly and the long leg is curved inwardly, wherein the cross-section of the sections 2 decreases toward the tips, preferably in such a manner that the cross-sections of the tapered sections 2 decrease linearly or exponentially.

Furthermore, the invention inter alia relates to a slide grinding body 1 comprising two tapering sections 2 that originate from a base section 4 in a curved manner or in a curved and helical manner, wherein the geometry of the base cross-section 4 has curved flanks, wherein the middle base cross-section is the largest and the cross-section preferably decreases linearly or exponentially toward the tips of the sections 2.

Furthermore, the invention inter alia relates to a slide grinding body 1 comprising a number of tapering sections 2 that originate from a base cross-section 4, wherein the base cross-section 4 is not an isosceles base cross-section.

Furthermore, the invention in particular relates to a slide grinding body 1 in which the legs 6, 7 of the base cross-section are arched differently.

Furthermore, the invention in particular relates to a slide grinding body 1 in which the curved and helical sections 2 all have the same screwing direction.

Furthermore, the invention in particular relates to a slide grinding body 1 in which the curved and helical sections 2 have different screwing directions; in other words, the helices preferably have different screwing directions.

Furthermore, the invention in particular relates to a slide grinding body 1 in which the sections 2 originate symmetrically from the base cross-section 4.

Finally, it must be clarified that the invention relates to a slide grinding body 1 comprising a number of sections 2. In other words, the invention relates to a slide grinding body 1 comprising one or more sections 2. Therefore, the invention in particular also relates to such embodiments, not shown in the Figures, of the above-described slide grinding bodies in which the slide grinding body 1 only has a single tapering section 2 or substantially consists of a single section of such a kind. Furthermore, the invention also relates to such embodiments, not shown in the Figures, of the above-described slide grinding bodies in which the slide grinding body 1 not only has one or two, but rather three or more tapering sections 2 that originate from a corresponding base cross-section 4.

All of the features presented in the description, in the following claims, and in the drawings can be essential to the invention both individually and in any desired combination with one another. The disclosure content of the associated/enclosed priority documents (copy of the prior application) is hereby also included in full in the disclosure of the application, also for the purpose of also including features of these documents in claims of the present application.

REFERENCE NUMERAL LIST

1 slide grinding body, grinding body
2 section, tip, tapered section
3 curvature, helix
4 middle cross-section, base cross-section
5 triangle
6 short leg
7 long leg, concave side
8 edge
9 radius, transition radius

The invention claimed is:

1. A slide grinding body comprising at least two tapering sections that symmetrically originate from a middle base cross-section in a curved manner, or in a curved and helical manner, wherein the geometry of the middle base cross-section has curved flanks, wherein the middle base cross-section is the largest and a cross-section of the at least two tapering sections decreases toward tips of the at least two tapering sections, wherein the curved flanks of the middle base cross-section form a triangle in which two shorter legs of the triangle are convex and one longer leg of the triangle is concave.

2. The slide grinding body in accordance with claim 1, characterized in that the cross-sections of the tapering sections decrease linearly or exponentially.

3. The slide grinding body in accordance with claim 1, characterized in that the at least two tapering sections have helical curvatures that are rounded with a radius in a region of the middle base cross-section.

4. The slide grinding body in accordance with claim 1, characterized in that the middle base cross-section is rounded at its corners.

5. The slide grinding body in accordance with claim 1, characterized in that the tips of the at least two tapering sections are rounded.

6. The slide grinding body in accordance with claim 1, wherein the slide grinding body is configured to be used as a blasting grain, a grinding grain, a polishing agent, a drying agent, or a cleaning aid.

7. The slide grinding body in accordance with claim 1, wherein the at least two tapering sections have helical curvatures that project from the middle base cross-section in the same screwing direction.

8. The slide grinding body in accordance with claim 1, wherein the at least two tapering sections have helical curvatures that project from the middle base cross-section in different screwing directions.

9. A sickle-shaped slide grinding body comprising at least two tapering sections that symmetrically originate from a base cross-section in a curved manner, or in a curved and helical manner, wherein the base cross-section forms a triangle in which two shorter legs are curved outwardly and one longer leg is curved inwardly, wherein a cross-section of the at least two tapering sections decreases toward tips of the at least two tapering sections.

10. The slide grinding body in accordance with claim 9, wherein the slide grinding body is configured to be used as a blasting grain, a grinding grain, a polishing agent, a drying agent, or a cleaning aid.

11. The slide grinding body in accordance with claim 9, characterized in that the tips of the at least two tapering sections are rounded.

12. The slide grinding body in accordance with claim 9, wherein the at least two tapering sections are symmetrical with respect to the base-section.

13. A slide grinding body comprising two tapering sections that originate from a base cross-section in a curved and helical manner, wherein the two tapering sections have different screwing directions, wherein the geometry of the base cross-section has curved flanks that form a triangle, in which two shorter legs of the triangle are convex and one longer leg of the triangle is concave.

14. The slide grinding body in accordance with claim 13, wherein the slide grinding body is configured to be used as a blasting grain, a grinding grain, a polishing agent, a drying agent, or a cleaning aid.

15. The slide grinding body in accordance with claim 13, wherein the two tapering sections project from the middle base cross-section to rounded tips.

* * * * *